US007020914B2

(12) United States Patent
Miyakawa

(10) Patent No.: US 7,020,914 B2
(45) Date of Patent: Apr. 4, 2006

(54) SWING TYPE BABY BED

(75) Inventor: Kunio Miyakawa, Toyama-ken (JP)

(73) Assignee: Hiroyuki Sado, Toyama-ken (JP)

( * ) Notice: Subject to any disclaimer, the term of this patent is extended or adjusted under 35 U.S.C. 154(b) by 0 days.

(21) Appl. No.: 10/838,881

(22) Filed: May 4, 2004

(65) Prior Publication Data

US 2005/0144718 A1 Jul. 7, 2005

(30) Foreign Application Priority Data

Jan. 7, 2004 (JP) ..... 2004-1588

(51) Int. Cl.
*A47D 9/00* (2006.01)

(52) U.S. Cl. ..... 5/104; 5/101; 5/93.1; 5/124; 5/412

(58) Field of Classification Search ..... 5/93.1, 5/101, 103, 104, 241, 244, 124, 412
See application file for complete search history.

(56) References Cited

U.S. PATENT DOCUMENTS

| | | | | | |
|---|---|---|---|---|---|
| 99,636 | A | * | 2/1870 | Clippinger et al. | 5/241 |
| 398,517 | A | * | 2/1889 | Lawrence | 296/19 |
| 729,950 | A | * | 6/1903 | Lindsey | 5/244 |
| 888,045 | A | * | 5/1908 | Shaw | 5/104 |
| 1,397,693 | A | * | 11/1921 | Leonard et al. | 280/651 |
| 1,549,318 | A | * | 8/1925 | Locklin | 5/124 |
| 2,377,464 | A | * | 6/1945 | Tucker | 5/244 |
| 3,590,403 | A | * | 7/1971 | Mixon | 5/100 |
| 4,868,939 | A | * | 9/1989 | Tagtow | 5/103 |
| 4,977,631 | A | * | 12/1990 | Bretz | 5/118 |

* cited by examiner

*Primary Examiner*—Michael Trettel
(74) *Attorney, Agent, or Firm*—Flynn, Thiel, Boutell & Tanis, P.C.

(57) ABSTRACT

A swing type baby bed is made up of a combination of a bed body framed in a rectangular fence and having a floor board mounted therein, and an outer frame for suspending the bed body by coil springs at four corners thereof. Guide grooves are longitudinally provided on either longitudinal frames of the bed body or those of the outer frame at four corners thereof, and guide rollers which engage in the guide grooves are fixed to the other longitudinal frames of the outer frame or those of the bed body at the four corners.

3 Claims, 5 Drawing Sheets

SWING TYPE BABY BED

FIELD OF THE INVENTION

The invention relates to a swing type baby bed which is forced to swing up and down so as to be adapted for getting a baby bedded.

RELATED ART

A baby bed has been conventionally configured to support a floor board by four bents wherein lateral bars are installed between adjacent bents at the lower end part and middle thereof to structure a framework and the flat floor board is hung on the middle lateral bars provided midway. Fixed fences are provided at the right and left sides over the floor board, and upper lateral bars are suspended on the upper end of the front and rear bents, and many crosspieces are arranged in a column between the upper lateral bars and middle lateral bars. There are mounted free fences at both the front and rear sides so as to reverse to open and close between the right and left bents.

When the baby is forced to get bedded, the free fence at the front face is opened to get the baby laid on a mattress on a sleep floor board, then the free fence is closed, so that there is no likelihood that the baby falls down because the baby is surrounded at his or her periphery. Further, the dimensions of the free fence are set to such an extent that the baby does not get beyond the free fence even if the baby stands up, thereby preventing the baby from falling down. However, in the case where the baby is grown up unnoticed and stands up and leans to the free fence, the baby is unable to poise to get beyond the free fence, whereby the baby tumbles down and falls down. In most cases, parents are not aware of the time of growth of the baby.

Although there is an effect to swing a baby in addition to sing a lullaby so as to get a baby bedded so that the baby sleeps, a conventional baby bed cannot be operated to let the baby go to sleep by swinging the baby bed up and down because a floor board is hung by middle lateral bars and fixed thereto. However, there is a case of using a bed having a pair of long leg members fixed to the bed in such a manner that a ski is curved in the shape of a bow so as to swing an entire bed, which has however a problem that a baby who can stand up and walk is liable to tumble down and fall down from the bed, and further the swinging is very strong in the up-and-down and back-and-forth directions, which exerts a bad influence upon the standing posture of the baby.

SUMMARY OF THE INVENTION

In view of the circumstances set forth above, it is an object of the invention to provide a safety swing type baby bed which is quietly swingable with stability so as to get a baby bedded so that the baby sleeps, and also which prevents the baby from falling down from the bed even if the baby can stand up and walk because the swinging is in a vertical direction.

To achieve the above object, it is an object of the invention to provide a swing type baby bed which is characterized in comprising a combination of a bed body which is framed in a rectangular fence and a floor bed mounted therein, and an outer frame which is rectangularly framed for suspending the bed body by coil springs at four corners, wherein guide grooves are longitudinally provided on either longitudinal frames of the bed body or those of the outer frame at four corners thereof, and guide rollers to engage with the guide grooves are fixed to the other longitudinal frames of the outer frame or those of the bed body at the four corners.

With such a configuration of the baby bed, since the bed body is suspended by the outer frame by each coil spring at the four corners, the bed body is swingable but the swinging of the bed is limited to a vertical direction alone by the engagement between the guide grooves and guide rollers, and further a smooth up-and-down motion can be obtained without generating frictional resistance by the guide rollers.

As mentioned above, according to the swing type baby bed of the invention, since the swinging of the bed body is limited to the vertical direction alone, there is an excellent effect that the baby bed is quietly swingable with stability without applying stimulation to the baby when getting the baby bedded, and the bed can be safely moved up and down to prevent the baby from falling down or tumbling down even if the baby moves in a standing posture.

Further, since the bed body has a front frame with a slidable hinged door capable of moving up and down and the outer frame is open at the front face thereof, the bed is easily swingable and the baby can be easily put in or out from the bed. Still further, the floor board can be supported at different levels by selecting positions of floor receive bolts and floor receive nuts, thereby preventing the baby from falling down and tumbling down with certainty to allow the bed to be safer.

PREFERRED EMBODIMENT OF THE INVENTION

Figure 1:
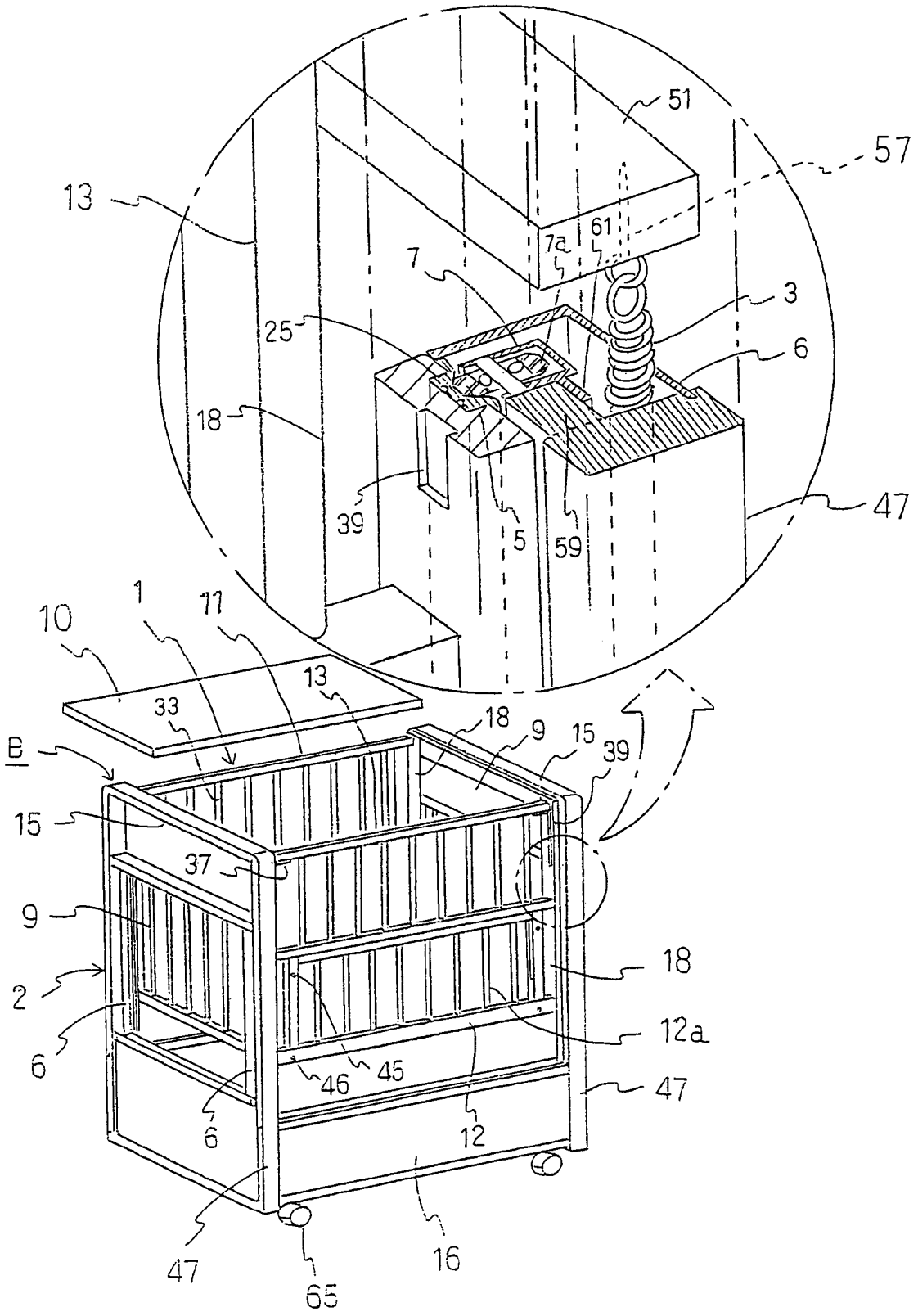
FIG. 1 is a perspective view of a swing type baby bed according to an embodiment of the invention, and a part of is enlarged in an imaginary circle shown by a pulled out arrow, thereby showing an internal structure thereof.
Figure 2:
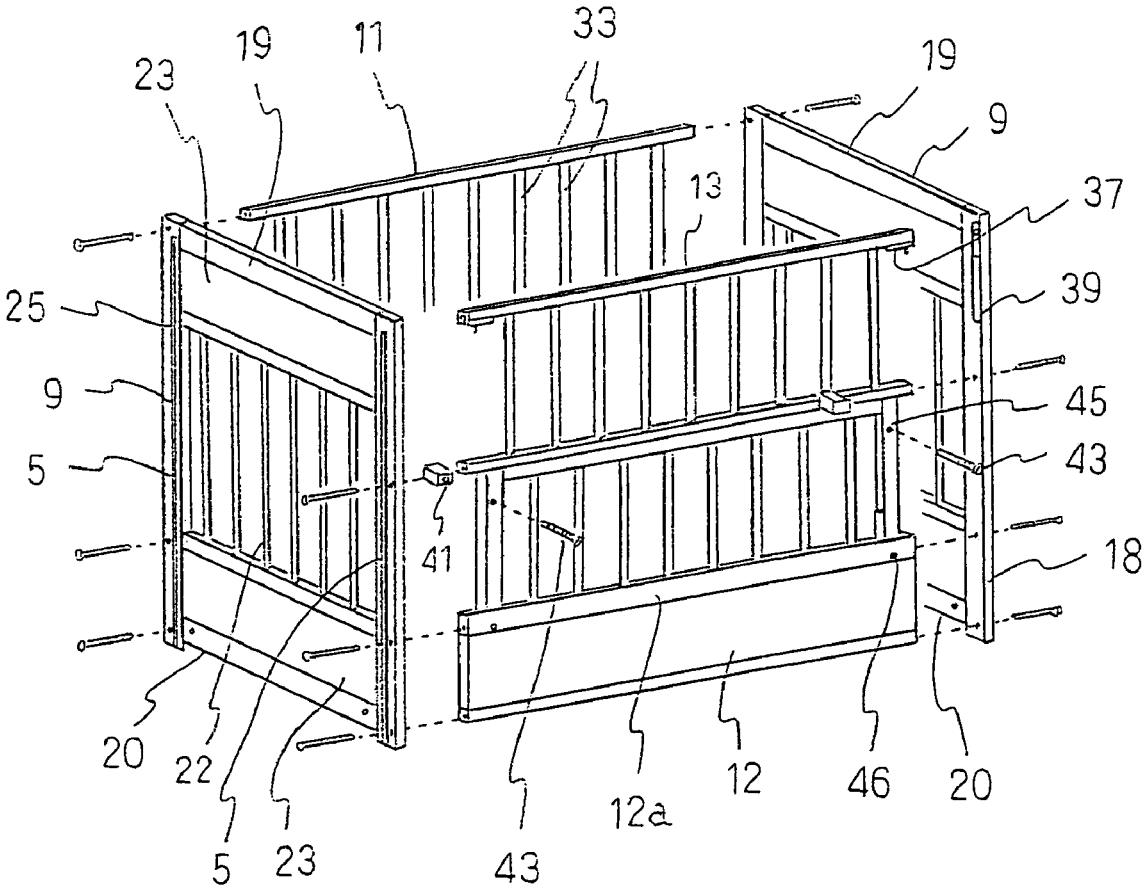
FIG. 2 is an exploded perspective view of a baby body of the swing type baby bed.
Figure 3:
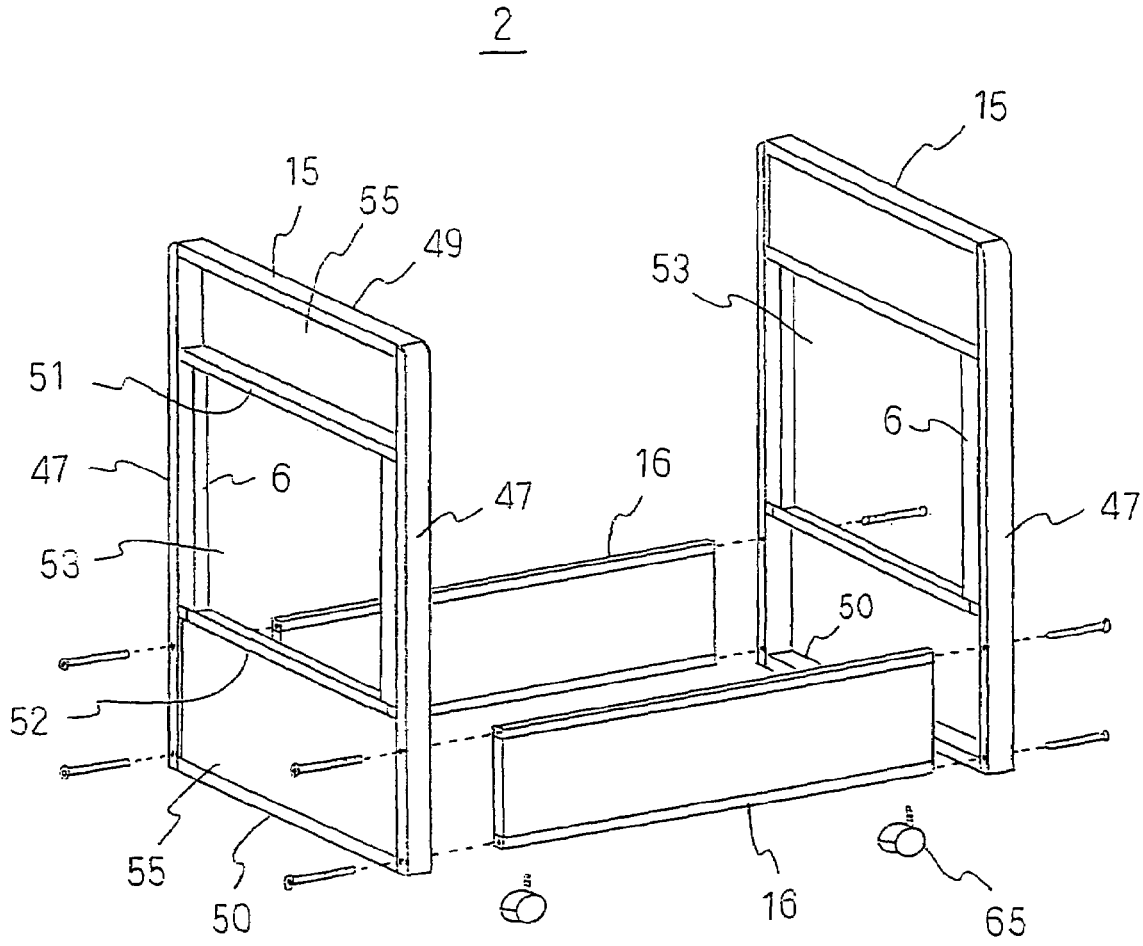
FIG. 3 is an exploded perspective view of an outer frame of the swing type baby bed.
Figure 4:
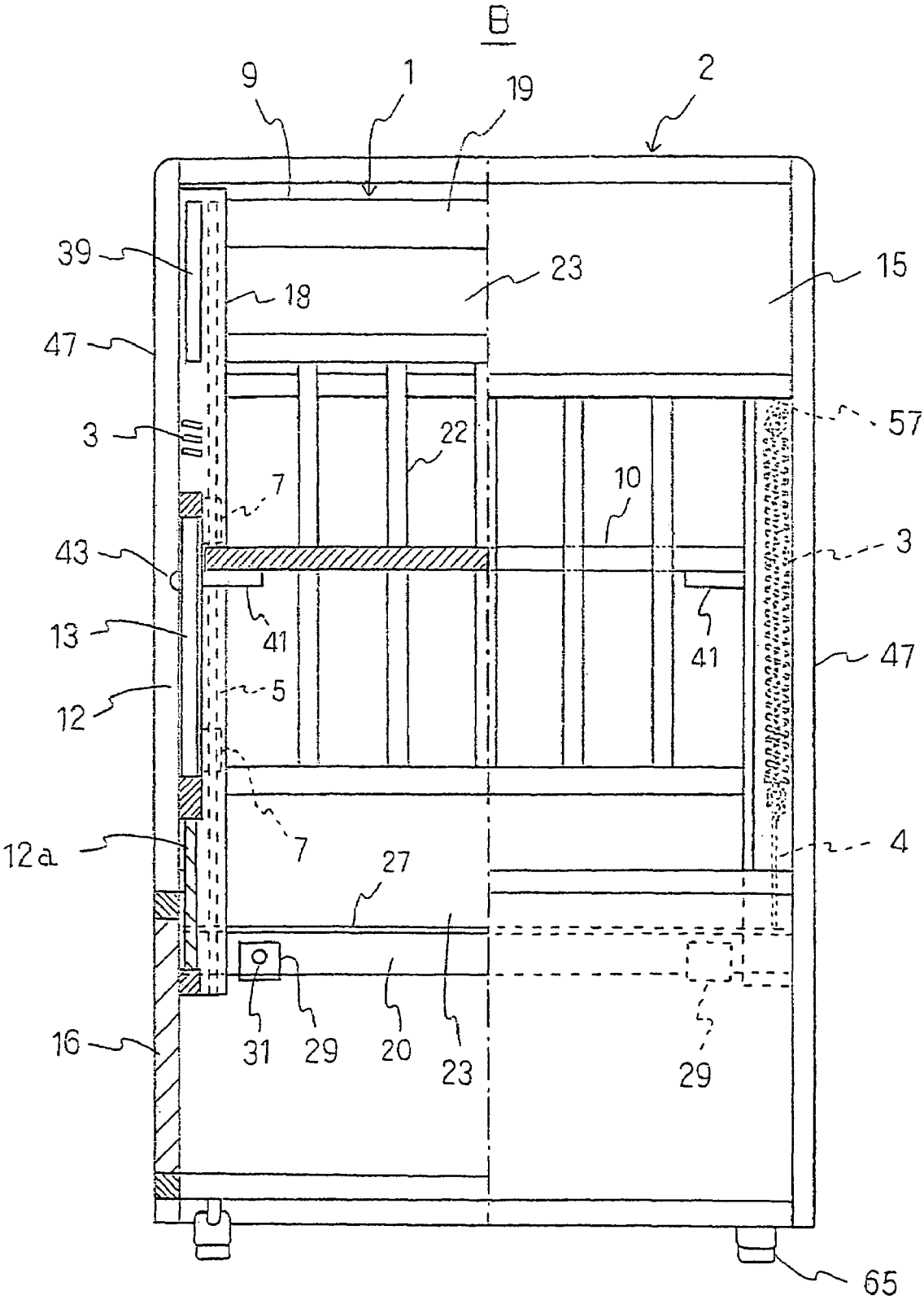
FIG. 4 is a side view of the swing type baby bed, wherein a half thereof is sectioned.

FIGS. 1 to 5 show an embodiment of the invention. A swing type baby bed B comprises a combination of a bed body 1 in which a baby is put, and an outer frame 2 in which the bed body 1 is vertically and swingable, wherein the bed body 1 is suspended by the outer frame 2 at four corners thereof using coil springs 3, 3, 3, 3 and a pair of vertical guide rollers 7, 7 are engaged in the guide grooves 5, 5, 5, 5 provided at four corners so as to effect the vertical swinging of the bed body 1 with the telescopic motion of the coil springs 3, 3, 3, 3 (FIGS. 1 and 4). A vertical swing mechanism comprising these components are sealed not to be seen from outside by a L-shaped cover 6 in cross section.

The bed body 1 and the outer frame 2 can be assembled by a user using assembling bolts. FIG. 2 is an exploded perspective view of the bed body 1 in an assembling step and FIG. 3 is an exploded perspective view of the outer frame 2. The bed body 1 comprises a combination of right and left end frames 9, 9, a rear frame 11 and a front frame 12 provided with a slide hinged door 13. A floor board 10 is housed in the bed body 1 during assembling of the right and left end frames 9, 9, the rear frame 11 and the front frame 12.

The outer frame 2 comprises a combination of right and left frames 15, 15 and front and rear side frames 16, 16.

Explained specifically first is the bed body 1 (FIG. 2), wherein the right and left end frames 9, 9 are provided in a state where each upper frame 19 and each lower frame 20 are sandwiched by front and rear longitudinal frames 18, 18, and a lattice 22, having a plurality of longitudinal cross pieces arranged in a column, is engaged in such a framework, and further end plates 23, 23 are fitted in the upper and lower portions of the lattice 22. Recessed grooves 25 are formed in the longitudinal frames 18, 18 at side outer faces thereof, and plastic long members of the guide grooves 5 engage with the recessed grooves 25. Even if the guide grooves 5 are formed in the shape of a rail like the relation between a door roller and the rail, it is not beyond the gist of the invention.

Figure 5:
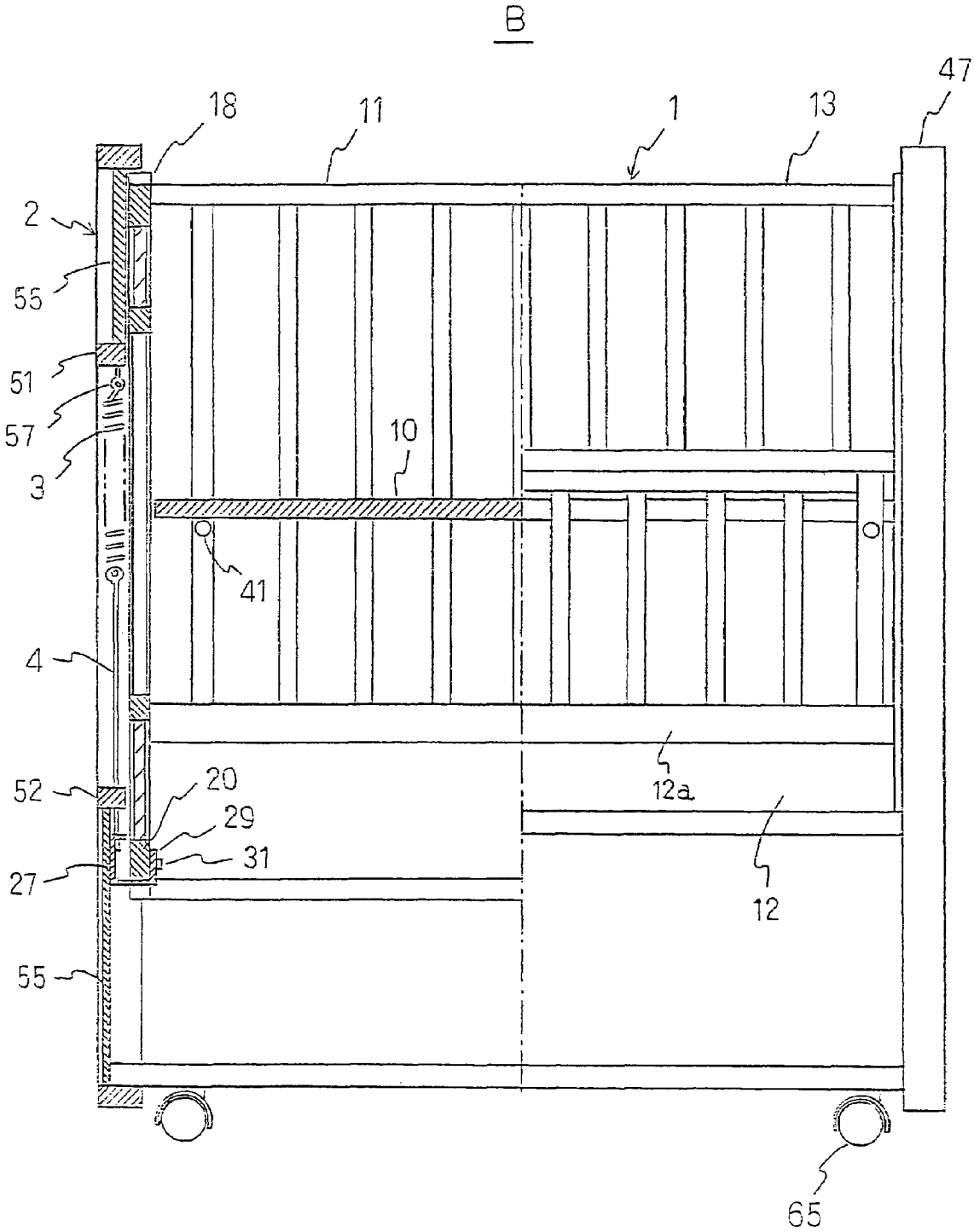
FIG. 5 is a side view of the swing type baby bed, wherein another half thereof is sectioned.

Although the coil springs 3 are stopped by each lower frame 20 provided at the lower end of the right and left end frames 9, 9 so as to suspend the bed body 1, since the coil springs 3 are provided vertically along the outer faces of the longitudinal frames 18, 18, coupling hardware 27 which extends outward are fixed to the lower frame 20 (FIG. 4, FIG. 5). Holding pieces 29, 29 protrude from both ends of the coupling hardware 27 and they are fixed to the lower frame 20 by screws 31, 31. Thus, the coil springs 3 keep vertically the bed body 1 so that the bed body 1 can be easily moved up and down with safety. Wire members 4 are connected to the coil springs 3 as lower end thereof and through holes of the wire members 4 are bored in lower middle cross pieces 52.

The rear frame 11 is a frame structure having longitudinal cross pieces 33, 33, . . . arranged in a column and substantially the same height as the right and left end frames 9, 9, and the entire rear frame 11 is connected to the right and left end frames 9, 9 by assembling bolts. Although a body 12*a* of the front frame 12 is connected to the right and left end frames 9, 9, it has a slidable hinged door 13 which is movable up and down so as to be opened or closed at an upper half thereof, wherein clips 37, 37 provided with lock clips are fixed to both ends of upper frame 35 of the slide hinged door 13, and slide grooves 39, 39 which engage with the clips 37, 37 are provided on the longitudinal frames 18, 18 of the right and left end frames 9, 9. Accordingly, when the slide hinged door 13 moves up and down, the upper half of the front frame 12 opens or closes.

Although the floor board 10 is suspended by the rear frame 11 and the front frame 12 using a pair of right and left floor receive nuts 41, 41, through holes 45, 46 for upper and lower floor receive bolts 43 for receiving the floor board 10 are provided in an upper end portion and lower end portion of the body 12*a* of the front frame 12, so that the floor board 10 can be selectively installed thereby. FIG. 4 shows a state where the floor receive nuts 41 are fastened by the floor receive bolts 43 to install the floor board 10 at an upper stage position, wherein if the slide hinged door 13 is opened at the upper stage, the upper face of the floor board 10 is opened so that the bed body 1 is liable to be swingable up and down and the child is put in and removed from the baby bed with ease.

The outer frame 2 has a framework structure wherein right and left head frames 15, 15 each having a taller head are structured such that right and left longitudinal frames 47, 47 sandwich an upper frame 49 and a lower frame 50 to have a room so that the bed body 1 can descend (FIG. 3 to FIG. 5). Spaces between upper middle cross pieces 51 and lower middle cross pieces 52 form windows 53, and end plates 55, 55 are mounted on the upper and lower portions of the upper middle cross pieces 51 and lower middle cross pieces 52. Hooks 57 are fixed to the lower faces of the upper middle cross pieces 51 by screwing (FIG. 1, FIG. 5) and the coil springs 3 are hung down along the inner sides of the longitudinal frames 47, 47. The door rollers are fixed to the longitudinal frames 47, 47 serving as a pair of upper and lower guide rollers 7, 7.

The longitudinal frames 47, 47 of the outer frame 2 and the longitudinal frames 18, 18 of the bed body 1 have the relation wherein one face thereof crosses at a right angle (FIG. 1) and the guide grooves 5 are provided on each one face of the longitudinal frames 18, 18 of the bed body 1. When the guide rollers 7 are fixed to the longitudinal frames 47, protrusions 59 protrude from the faces of the longitudinal frames 47 of the outer frame 2, and the guide rollers 7 are fixed to the tip ends of the protrusions 59 by screws so that rollers 7*a* of the guide rollers 7 engage with the guide grooves 5. Screw stopper pieces 61 protrude from the frames of the guide rollers 7 which strike against the side faces of the protrusions 59.

The side frames 16, 16 are formed in a plate shape having a width capable of connecting the head frames 15, 15 thereto at the lower end thereof and casters 65, 65 are fixed to both right and left ends of the side frames 16, 16.

What is claimed is:

1. A swing baby bed comprising a bed body, a floor board mounted in said bed body and a rectangular outer frame for supporting the bed body by coil springs provided at four corners of the bed body, said bed body comprising longitudinal right and left end frames, a rear frame and a front frame, the front frame comprising a fixed front frame and a hinged door which opens and closes along a horizontal axis and the outer frame comprising a pair of head frames for suspending the coil springs and side frames for connecting the head frames, the side frames having a lower height than the head frames, wherein longitudinally extending guide grooves are provided on either the longitudinal end frames of the bed body or on the outer frame at four corners thereof and guide rollers for engaging with the longitudinally extending guide grooves are provided on the other of the longitudinal end frames of the bed body or on the outer frame at four corners thereof so that said bed body is constrained to move only in the longitudinal direction.

2. A swing baby bed according to claim 1, wherein the hinged door has clips provided with lock clips at upper ends thereof and the longitudinal end frames have slide grooves for engaging with the lock clips.

3. A swing type baby bed according to claim 1, wherein the rear and front frames of the bed body have a pair of through holes for receiving floor receive bolts at front and rear portions thereof, which correspond to upper and lower positions of the front frame body, and floor receive nuts are threaded onto the floor receive bolts for supporting the floor board.

* * * * *